US007032889B1

(12) United States Patent
Moss et al.

(10) Patent No.: US 7,032,889 B1
(45) Date of Patent: Apr. 25, 2006

(54) ANTI-SCALING DEVICE

(76) Inventors: Frederick James Moss, Treetops, 12 Oak Way, Studham, Bedforshire LU6 2PE (GB); Janusz Lucien Holland, 111 Summerfiled Crescent, Edgbaston, Birmingham B16 0EN (GB); Mark Christopher Hughes, Rothwood, 17 Summerfield Road, Clent, Worcestershire DY9 9RG (GB)

( * ) Notice: Subject to any disclaimer, the term of this patent is extended or adjusted under 35 U.S.C. 154(b) by 0 days.

(21) Appl. No.: 10/031,928

(22) PCT Filed: Jul. 26, 1999

(86) PCT No.: PCT/GB99/02435

§ 371 (c)(1),
(2), (4) Date: Jun. 10, 2002

(87) PCT Pub. No.: WO01/07733

PCT Pub. Date: Feb. 1, 2001

(51) Int. Cl.
*E04H 17/00* (2006.01)

(52) U.S. Cl. ..... 256/12; 256/3; 256/11

(58) Field of Classification Search ..... 256/1, 256/3, 11, 12

See application file for complete search history.

(56) References Cited

U.S. PATENT DOCUMENTS

| | | | | |
|---|---|---|---|---|
| 435,708 | A * | 9/1890 | Poole | 256/12 |
| 4,739,970 | A * | 4/1988 | Francis | 256/1 |
| 4,815,896 | A * | 3/1989 | Fox et al. | |

FOREIGN PATENT DOCUMENTS

| | | | |
|---|---|---|---|
| DE | 8624656 | | 1/1987 |
| EP | 0242092 | A | 10/1987 |
| GB | 2076038 | A | 11/1981 |
| GB | 2225598 | A | 6/1990 |
| GB | 2234273 | A | 1/1991 |
| GB | 2290565 | A | 1/1996 |

* cited by examiner

*Primary Examiner*—Daniel P. Stodola
*Assistant Examiner*—Victor MacArthur
(74) *Attorney, Agent, or Firm*—Gauthier & Connors LLP

(57) ABSTRACT

An anti-scaling device comprises a hollow central body for mounting on a bar and several spike units extending outwardly from the body in different directions. Pairs of spike units are rotatably and preferably detachably mounted on opposite sides of the central body. The device may further comprise serrated webs extending outwardly from the central body between the spike units. The device may also comprise rows of sharp-edged teeth axially aligned along the central body. Alternatively, the spike units may be partially rotatable serrated propellers or may be pivotably rotatably mounted. The device may be moulded from plastic material.

11 Claims, 7 Drawing Sheets

ANTI-SCALING DEVICE

FIELD OF INVENTION

This invention relates to anti-scaling device, particularly rotary anti-sealing devices which can be positioned on top of fences, walls and gates in order to prevent potential intruders scaling such structures.

DESCRIPTION OF ART

Rotary anti-scaling devices generally comprise metal spike units extending from a central mounting bar or vanes of expanded metal projecting from a central rotary bar. These arrangements are prone to scaling using rope and are of relatively fragile construction. Furthermore they are relatively expensive to produce and are aesthetically unappealing.

Other device consist of two identical halves of plastics material designed to connect together to form unitary spikes and be rotatably mounted on an associated bar.

It is an object of the present invention to provide a more effective anti-scaling device of relatively inexpensive construction.

SUMMARY OF THE INVENTION

According to the present invention there is provided an anti-scaling device comprising a hollow central body portion for mounting on a bar and several spike units extending outwardly from the body portion in different directions wherein the spike units are rotatably mounted and preferably rotatably and detachably mounted on the central body portion.

Preferably there are pairs of spike units extending in a diametrically opposed relationship from the central body portion. It is convenient to make the spike unit separately from the body portion and to mount the spike units for rotation about radial axes extending out from the body portion. In addition serrated webs can be disposed between the spike units. This particular construction makes it virtually impossible for an intruder to grab hold of any part of the device, tamper with or attach a rope to it.

The spike unit may have a plurality of generally arcuate blade-like projections with sharp edges and a sharp tip. These spike units when not in use can be detached and replaced in the event of any damage or according to the structure they are securing.

The device with its various components may be made from any tough, resilient material. Ideally, the device is moulded from a plastics material, particularly a high impact thermoplastic material. The device with its various components can come in an assortment of colours for decorative purposes.

In use the anti-scaling device is rotatable mounted on a bar which passes through the hollow central body portion alone the transverse axis. Preferably a plurality of such anti-scaling devices are rotatably mounted on a bat with the ends of respective central body portions abutting each other. The bar can then be fixed to an associated structure such as a fence, gate or wall etc.

The invention may be understood more readily and various other aspects and features of the invention may become apparent front consideration of the following description.

Embodiments of the present invention will now be described with reference to the accompanying drawings in which:

DETAILED DESCRIPTION OF THE INVENTION

Figure 1:
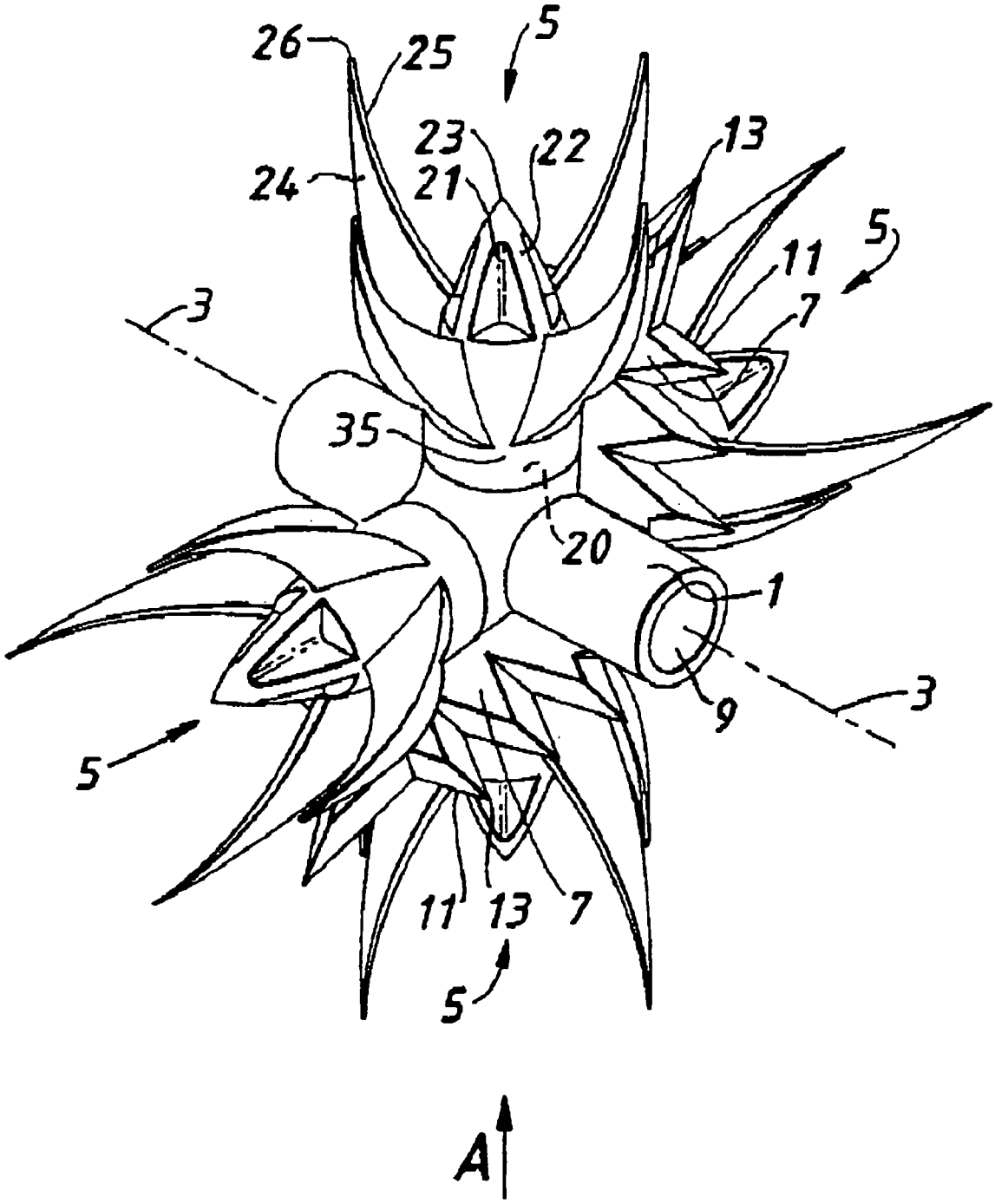
FIG. 1 is a perspective view of a first embodiment of an anti-scaling device constructed in accordance with the invention.
Figure 2:
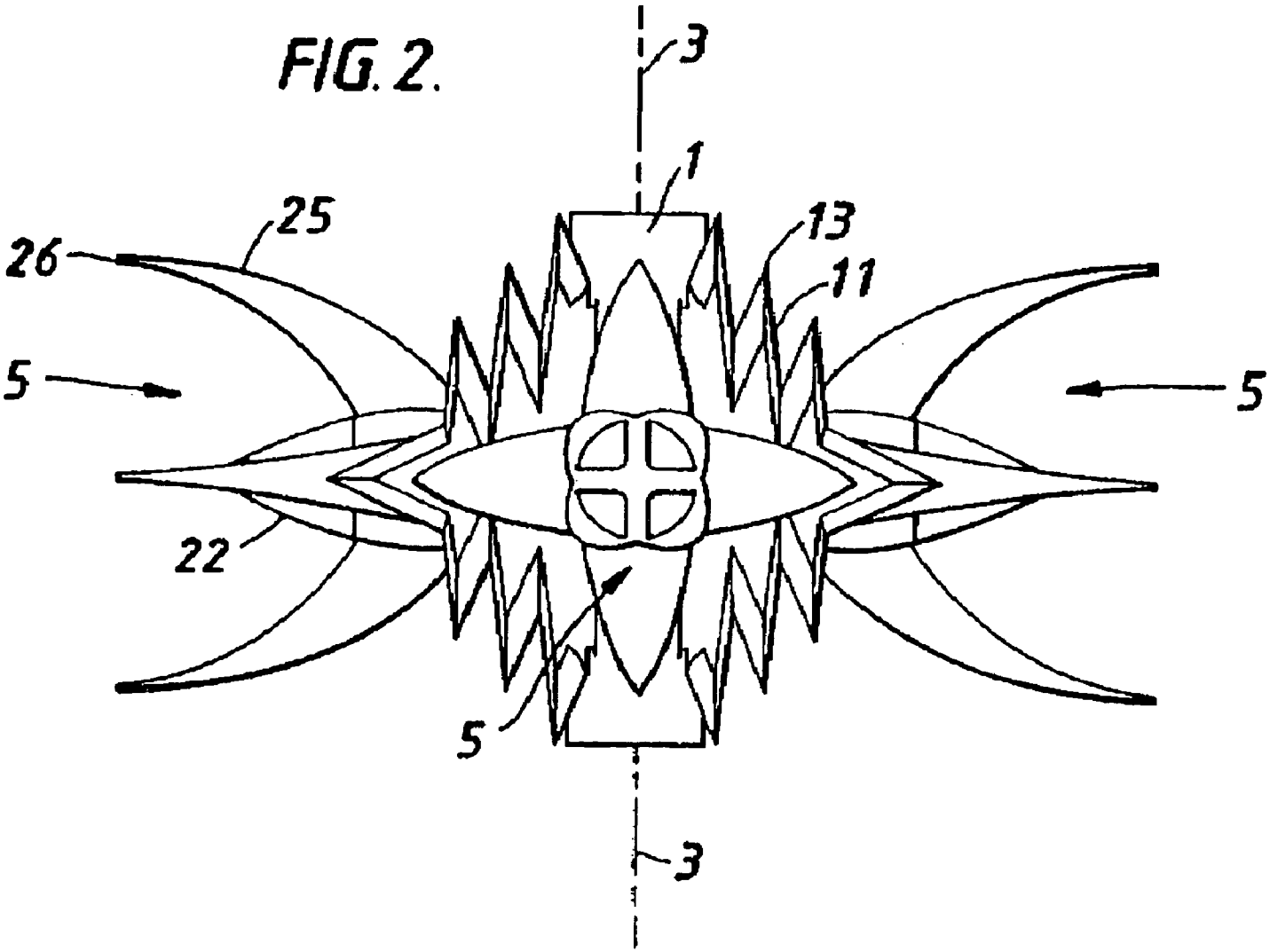
FIG. 2 is an inverted plan view of the first embodiment of the anti-scaling device taken in the direction of arrow A in FIG. 1.
Figure 3:
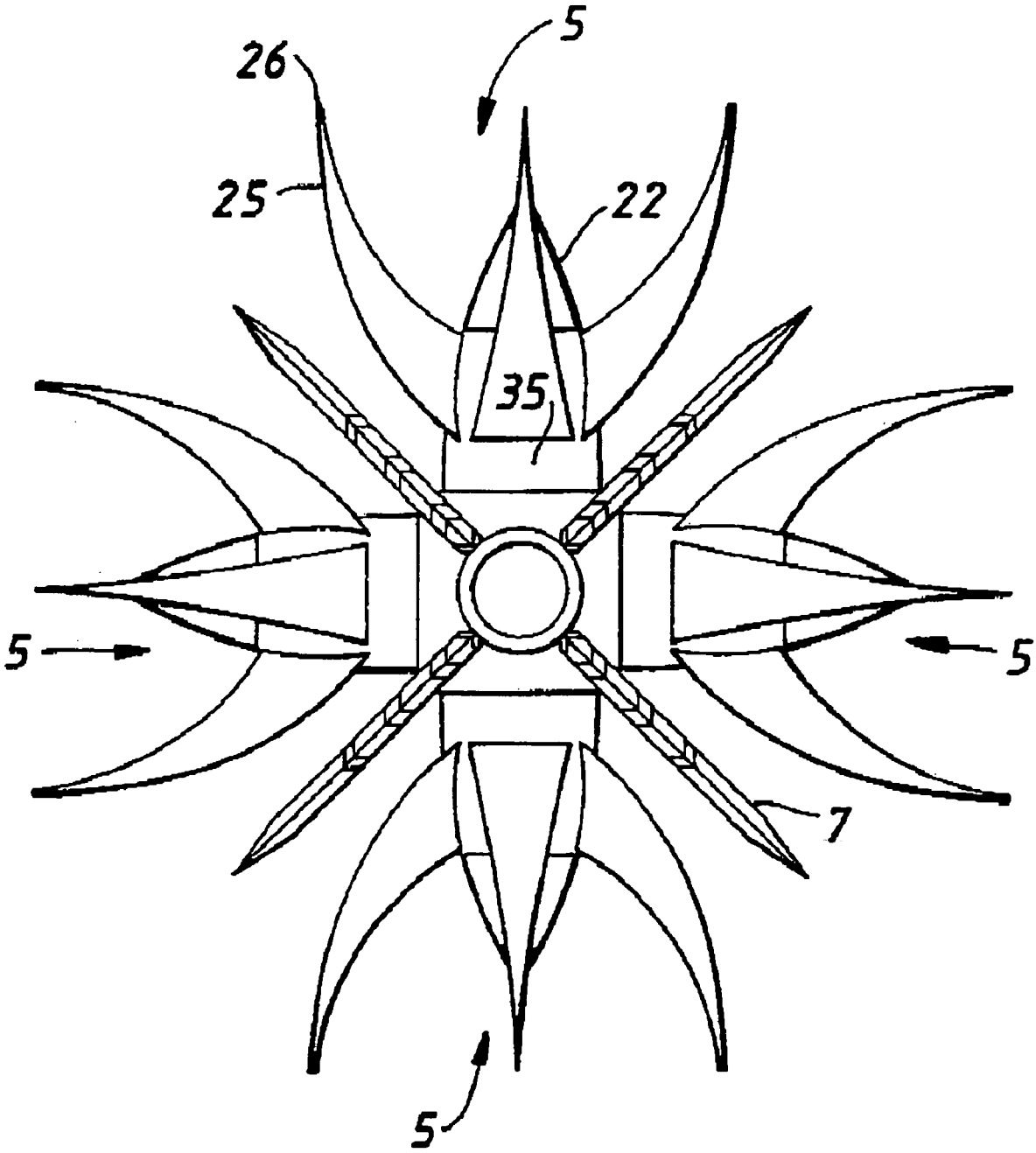
FIG. 3 is a side view of the first embodiment of the anti-scaling device.

Referring to FIGS. 1, 2 and 3 the first embodiment of the device is composed of components moulded from a suitable plastics material and comprises a hollow central body portion 1 of a generally elongate cylindrical shape with a bore 9 extending along a central transverse axis 3. Extending radially in a diametrically opposed relationship from the central body portion 1 are two pairs of spigots (not shown) upon which separate spike units 5 are detachably and rotatably mounted. Each spike unit 5 has a central boss portion 21 composed of spaced apart webs 22 which taper inwardly to an apex 23. Surrounding the central portion 21 there are four arcuate blades 24 with knife-like sharp edges 25 and a sharp tip 26. Each unit 5 has a hollow base collar 35 which fits onto one of the spigots 20. Conveniently the collar 35 may have an internal rib which snap-fits into a groove in the spigot 20 so as to retain the units 5 on the spigot 20 yet allow for rotation thereabout. Also extending radially in a diametrically opposed relationship from the central body portion are two pairs of serrated webs 7 having sharp edges 11 and points 13, these webs extend along axes displaced 45° from the spigot axes (for clarity, only two webs are illustrated in FIG. 1).

Figure 4:
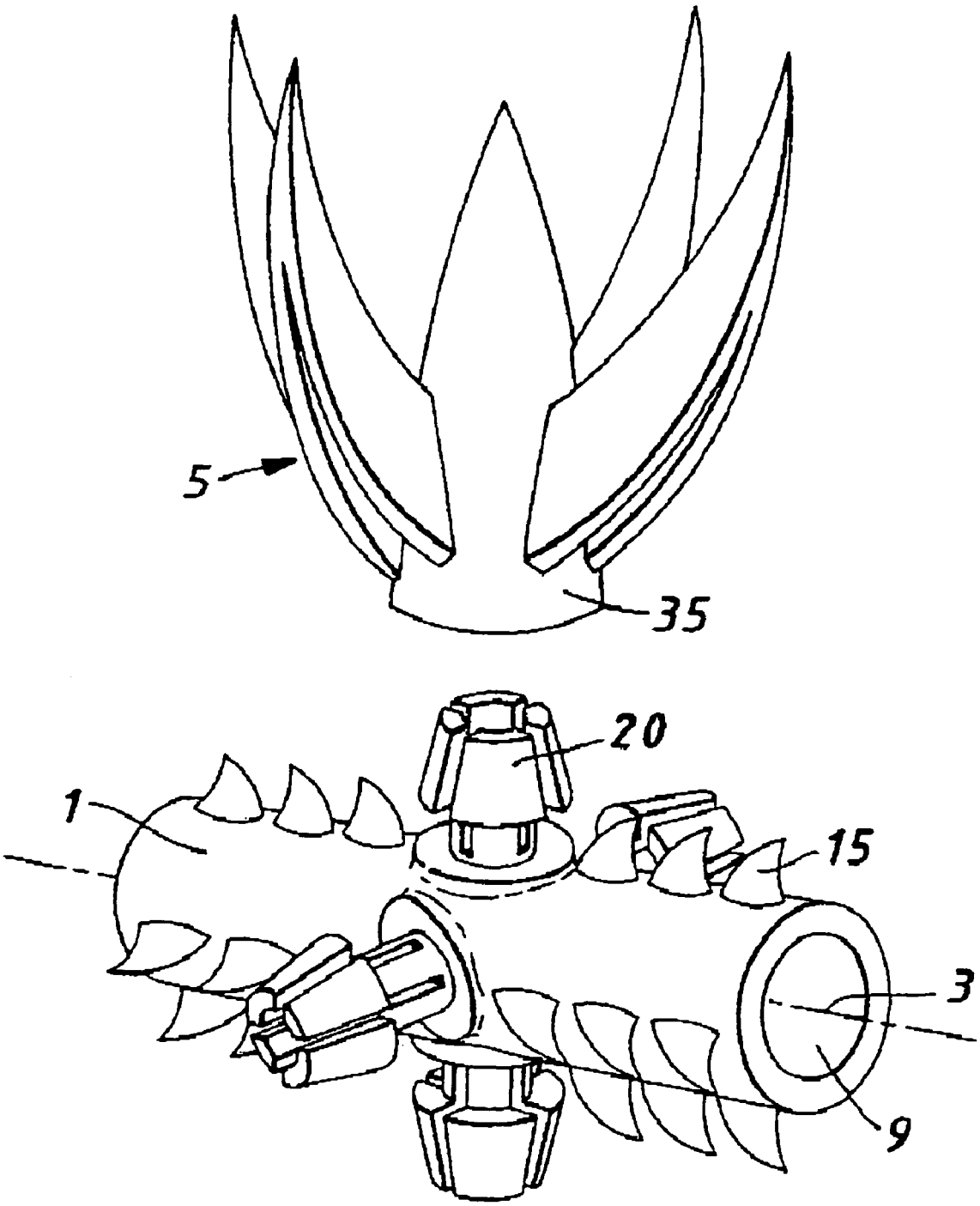
FIG. 4 is an expanded perspective view illustrating a second embodiment of an anti-scaling device constructed in accordance with the invention.

FIG. 4 shows the second embodiment of the device. Like the first embodiment this embodiment comprises a central body portion 1 with bore 9 and diametrically opposed spike units 5 (of which only one is shown). Spigots 20 detachably and rotatably mount the spike units 5 to the central body 1. Four axially aligned rows of sharp-edged teeth 15 are positioned along the central body.

Figure 5:
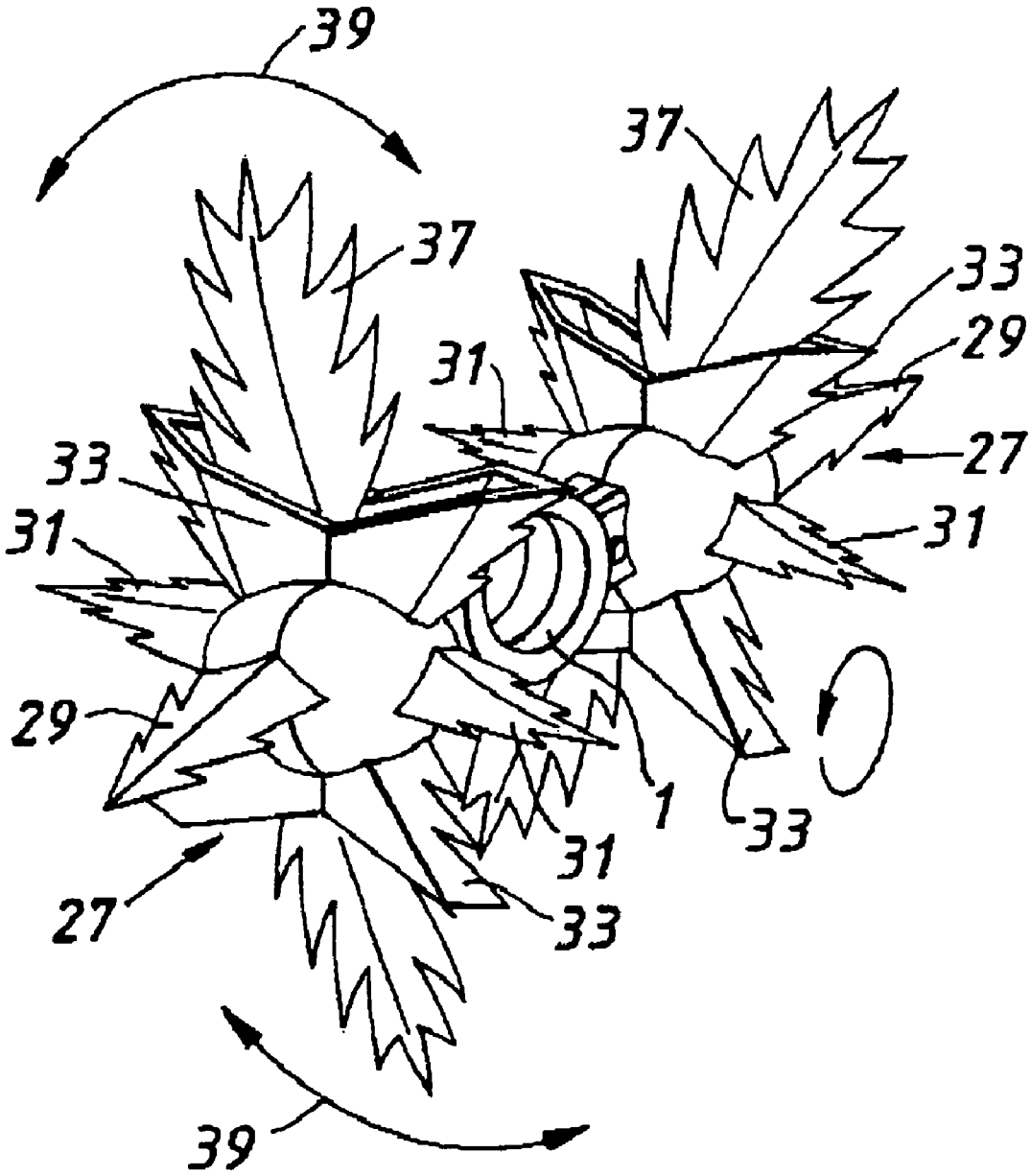
FIG. 5 is a perspective view of a third embodiment of an anti-scaling device constructed in accordance with the invention.
Figure 6:
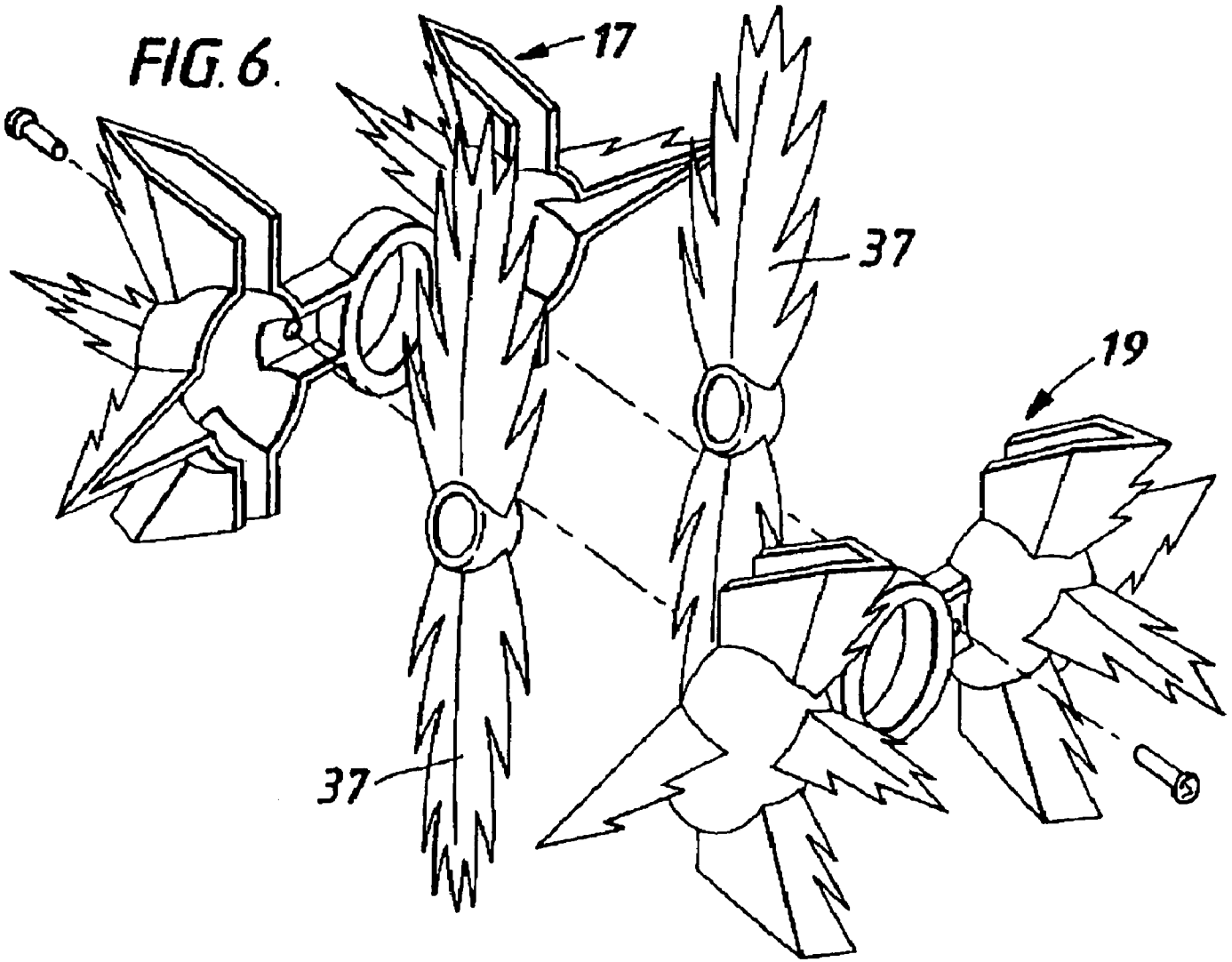
FIG. 6 is an expanded view of the embodiment shown in FIG. 5.

FIGS. 5 and 6 show the third embodiment. The central body portion 1 is formed from two identical halves 17, 19. When assembled (FIG. 5) the two halves 17, 19 form two radially extending and diametrically opposed sheath units 27. These sheath units 27 each comprise a radial dagger-like serrated blade 29, two diametrically-opposed axially aligned dagger-like serrated blades 31 and two externally serrated tangential sheaths 33. The sheaths 33 each hold a serrated two-bladed propeller 37 rotatably mounted analogous to the spike units 5 of the previous embodiments. The sheaths 33 allow the propellers 37 to partially rotate backwards and forwards as indicated by the arrows 39.

Figure 7:
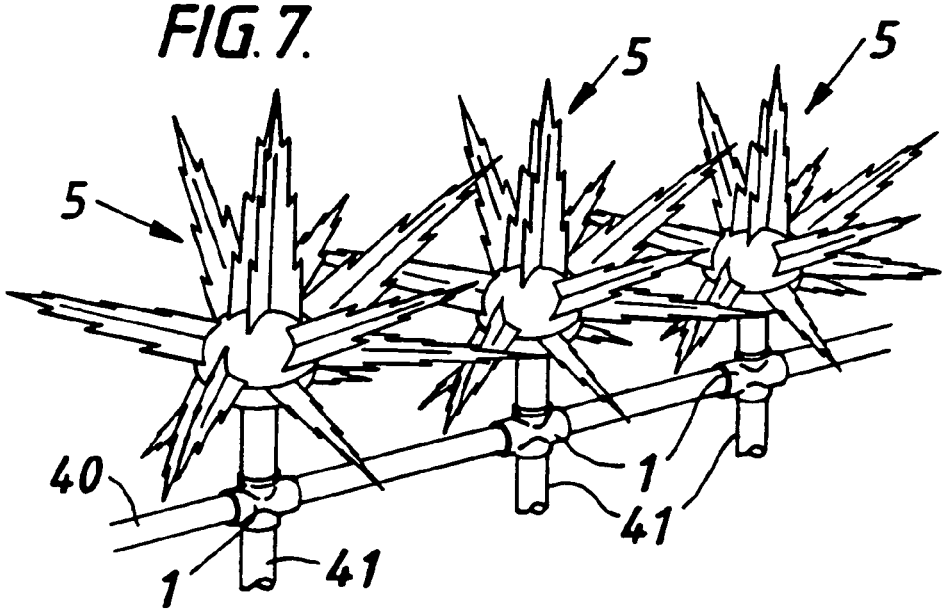
FIG. 7 is a perspective view of three bar-mounted illustrations of a fourth embodiment of an anti-scaling device constructed in accordance with the invention.
Figure 8:
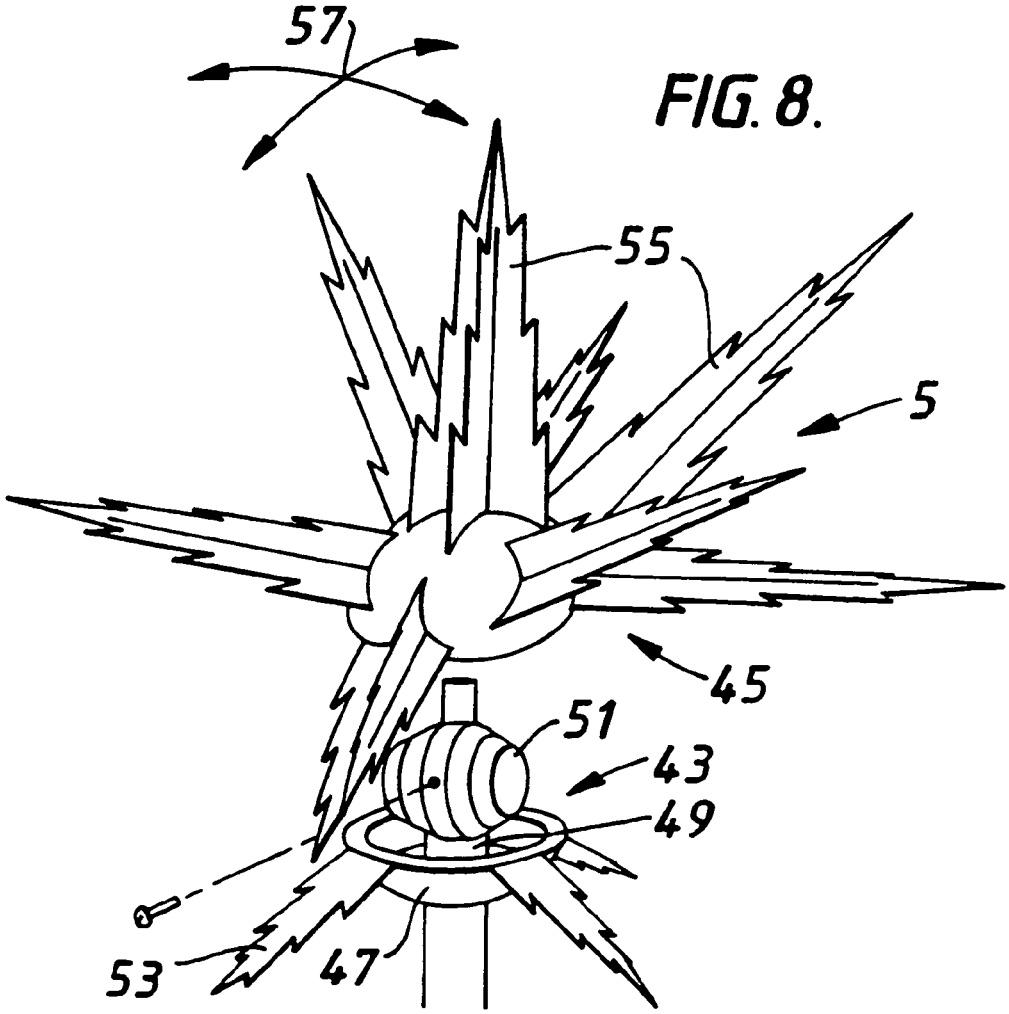
FIG. 8 is an expanded view of part of the fourth embodiment shown in FIG. 7.

FIGS. 7 and 8 illustrate the fourth embodiment. In FIG. 7 three central body portions 1 are rotatably mounted on a bar 40. Two spike units 5 are mounted on each central body portion 1 although only one is fully illustrated. The lower spike unit stem 41 represents the second spike unit in each case. As can be seen the two spike units are diametrically opposed. In another embodiment based on this fourth embodiment four diametrically opposed spike units pet central body portion are present analogous to the first and second embodiments described above. As can be seen from FIG. 8 in this fourth embodiment each spike unit 5 comprises a stem portion 43 and a cap portion 45. The stem portion 43 is attached to the central body and extends radially outwards to a moulded retention cup 47 which surrounds a radial pole 49 on which a moulded sphere 51 is mounted. Three serrated protrusions 53 extend radially from the retention cup 47. The cap portion 45 is covered in radially extending serrated protrusions 55 and sits on the moulded sphere 51 to pivot and rotate as a ball joint as illustrated by the arrows 57. A moulded spring is disposed on the pole 49 to centre the cap portion 45 generally as well as after tampering.

Although the present invention has been described with reference to several embodiments, it is apparent that the present invention is not limited to the aforesaid embodiments, but various modifications can be attained without departing from its scope.

The invention claimed is:

1. An anti-scaling device comprising a hollow central body portion mounted on a bar for rotation around a transverse axis, said bar passing through the hollow central body portion along said transverse axis, several spigots or poles extending outwardly from the body portion in different directions and spike units each mounted on a said spigot or pole for rotation around axes non-congruent with the transverse axis.

2. An anti-scaling device according to claim 1, wherein the spike units are detachably mounted on said spigots or poles.

3. An anti-scaling device according to claim 1, wherein there are pairs of spike units disposed in a diametrically opposed relationship relative to the central body portion.

4. An anti-scaling device according to claim 1, wherein the central body portion has spigots for mounting the spike units.

5. An anti-scaling device according to claim 1 further comprising serrated webs extending outwardly from the central body portion between the spike units.

6. An anti-scaling device according to claim 5, wherein the serrated webs extend along radial axes displaced 45° from the radial axes of the spike units.

7. An anti-scaling device according to claim 1, wherein rows of sharp-edged teeth are axially aligned along the central body portion.

8. An anti-scaling device according to claim 1, wherein the spike units are in the form of partially rotatable serrated propellers.

9. An anti-scaling device according to claim 1, wherein the spike units are pivotably mounted.

10. An anti-scaling device according to claim 1, wherein the device is moulded from a plastics material.

11. An anti-scaling device comprising a central body portion mounted on a bar for rotation around a transverse axis, said bar passing through the hollow central body portion along said transverse axis, a plurality of sheaths extending in different directions from the central body portion and a two bladed propeller projecting from and rotatable mounted in each sheath to rock backwards and forwards.

* * * * *